US012570921B2

(12) United States Patent
Yomogita

(10) Patent No.: US 12,570,921 B2
(45) Date of Patent: Mar. 10, 2026

(54) LUBRICATING OIL COMPOSITION, DIESEL ENGINE WITH MOUNTED SUPERCHARGER, AND USE METHOD FOR LUBRICATING OIL COMPOSITION

(71) Applicant: Idemitsu Kosan Co.,Ltd., Chiyoda-ku (JP)

(72) Inventor: Akinori Yomogita, Tokyo (JP)

(73) Assignee: Idemitsu Kosan Co., Ltd., Chiyoda-ku (JP)

( * ) Notice: Subject to any disclaimer, the term of this patent is extended or adjusted under 35 U.S.C. 154(b) by 0 days.

(21) Appl. No.: 17/906,237

(22) PCT Filed: Mar. 12, 2021

(86) PCT No.: PCT/JP2021/010097
§ 371 (c)(1),
(2) Date: Sep. 13, 2022

(87) PCT Pub. No.: WO2021/187370
PCT Pub. Date: Sep. 23, 2021

(65) Prior Publication Data

US 2023/0122231 A1 Apr. 20, 2023

(30) Foreign Application Priority Data

Mar. 16, 2020 (JP) ..... 2020-045632

(51) Int. Cl.

| | |
|---|---|
| ***C10M 169/04*** | (2006.01) |
| ***C10M 129/54*** | (2006.01) |
| ***C10M 129/76*** | (2006.01) |
| ***C10M 133/12*** | (2006.01) |
| ***C10M 133/44*** | (2006.01) |
| ***C10M 135/10*** | (2006.01) |
| ***C10M 137/10*** | (2006.01) |
| ***C10M 139/06*** | (2006.01) |
| ***C10M 141/12*** | (2006.01) |
| ***C10M 143/00*** | (2006.01) |

(Continued)

(52) U.S. Cl.

CPC ..... *C10M 169/044* (2013.01); *C10M 129/54* (2013.01); *C10M 129/76* (2013.01); *C10M 133/12* (2013.01); *C10M 133/44* (2013.01); *C10M 135/10* (2013.01); *C10M 137/10* (2013.01); *C10M 139/06* (2013.01); *C10M 141/12* (2013.01); *C10M 143/00* (2013.01); *C10M 161/00* (2013.01); *C10M 2203/1025* (2013.01); *C10M 2205/02* (2013.01); *C10M 2207/144* (2013.01); *C10M 2207/262* (2013.01); *C10M 2207/285* (2013.01); *C10M 2215/26* (2013.01); *C10M 2215/30* (2013.01); *C10M 2219/044* (2013.01); *C10M 2223/045* (2013.01); *C10M 2227/061* (2013.01); *C10N 2020/071* (2020.05); *C10N 2020/073* (2020.05); *C10N 2030/04* (2013.01); *C10N 2030/06* (2013.01); *C10N 2030/10* (2013.01); *C10N 2030/52* (2020.05); *C10N 2040/252* (2020.05)

(58) Field of Classification Search

CPC ..... C10M 129/54; C10M 129/76; C10M 133/12; C10M 133/44; C10M 135/10; C10M 137/10; C10M 139/06; C10M 141/12; C10M 143/00; C10M 161/00; C10M 169/044; C10M 2203/1025; C10M 2205/02; C10M 2207/144; C10M 2207/262; C10M 2207/285; C10M 2215/26; C10M 2215/30; C10M 2219/044; C10M 2223/045; C10M 2227/061; C10M 163/00; C10M 2207/289; C10M 2215/064; C10M 2215/28; C10N 2030/04; C10N 2010/04; C10N 2020/02; C10N 2020/04; C10N 2020/071; C10N 2020/073; C10N 2030/02; C10N 2030/06; C10N 2030/10; C10N 2030/42; C10N 2030/52; C10N 2040/252; C10N 2040/253; C10N 2060/14

See application file for complete search history.

(56) References Cited

U.S. PATENT DOCUMENTS

2008/0020953 A1 1/2008 Kamano et al.
2010/0075875 A1 3/2010 Yaguchi
(Continued)

FOREIGN PATENT DOCUMENTS

EP 2133406 A1 * 12/2009 ..... C10M 141/12
JP 2003-41283 A 2/2003
(Continued)

OTHER PUBLICATIONS

International Search Report mailed on May 18, 2021 in PCT/JP2021/010097 filed on Mar. 12, 2021 (4 pages).

*Primary Examiner* — Latosha Hines
(74) *Attorney, Agent, or Firm* — Oblon, McClelland, Maier & Neustadt, L.L.P.

(57) ABSTRACT

A lubricating oil composition may include a base oil (A), succinimide (B) which has not been modified with boron, succinimide (C) modified with boron, a metallic detergent (D), and an antioxidant (E), wherein the ratio of the content of boron atoms derived from ingredient (C) to the content of nitrogen atoms derived from ingredients (B) and (C), B/N, is 0.30 or less by mass, the lubricating oil composition satisfying requirement (I) and/or requirement (II). Requirement (I): Ingredient (D) includes a metallic detergent (D1) having a base value less than 100 mgKOH/g. Requirement (II): Ingredient (E) includes an amine-based antioxidant (E1), the content of ingredient (E1) being 1.00 mass % or less.

20 Claims, No Drawings

(51) Int. Cl.

| | |
|---|---|
| ***C10M 161/00*** | (2006.01) |
| ***C10N 20/00*** | (2006.01) |
| ***C10N 30/00*** | (2006.01) |
| ***C10N 30/04*** | (2006.01) |
| ***C10N 30/06*** | (2006.01) |
| ***C10N 30/10*** | (2006.01) |
| ***C10N 40/25*** | (2006.01) |

(56) References Cited

U.S. PATENT DOCUMENTS

| | | | | |
|---|---|---|---|---|
| 2010/0113313 | A1 | 5/2010 | Teshima et al. | |
| 2010/0137172 | A1 | 6/2010 | Kamano | |
| 2010/0218740 | A1 | 9/2010 | Teshima et al. | |
| 2012/0090568 | A1 | 4/2012 | Teshima et al. | |
| 2018/0100112 | A1 | 4/2018 | Honda et al. | |
| 2018/0171259 | A1* | 6/2018 | Yamasaki | C10M 133/40 |
| 2021/0032559 | A1* | 2/2021 | Sunahara | C10M 101/02 |

FOREIGN PATENT DOCUMENTS

| | | | | | |
|---|---|---|---|---|---|
| JP | 2003041283 | A | * | 2/2003 | |
| JP | 2006-176672 | A | | 7/2006 | |
| JP | 2008-144018 | A | | 6/2008 | |
| JP | 2009-102486 | A | | 5/2009 | |
| JP | 2010-100707 | A | | 5/2010 | |
| JP | 2016-196595 | A | | 11/2016 | |
| JP | 2019178296 | A | * | 10/2019 | C10M 101/02 |
| WO | WO 2008/117776 | A1 | | 10/2008 | |
| WO | WO 2008/120599 | A1 | | 10/2008 | |

* cited by examiner

LUBRICATING OIL COMPOSITION, DIESEL ENGINE WITH MOUNTED SUPERCHARGER, AND USE METHOD FOR LUBRICATING OIL COMPOSITION

CROSS-REFERENCE TO RELATED APPLICATIONS

The present application is the national stage of international application PCT/JP2021/010097, filed on Mar. 12, 2021, and claims the benefit of the filing date of Japanese Appl. No. 2020-045632, filed on Mar. 16, 2020.

TECHNICAL FIELD

The present invention relates to a lubricating oil composition, a diesel engine mounted with a supercharger applied with the lubricating oil composition, and a method for using the lubricating oil composition.

BACKGROUND ART

Since the temperature of a supercharger provided in a diesel engine mounted with a supercharger becomes high, the supercharger has a structure easily sucking engine oil mist. Thus, the mist floating in the periphery of the supercharger tends to be formed as deposit in the periphery of the supercharger. The larger the amount of exhaust gas of the engine is, the higher the temperature of the supercharger becomes and the more the intake of the engine oil mist increases, so that the formation of the deposit tends to increase. The deposit formed becomes a factor of adverse effects such as a decrease in the efficiency of a turbocharger.

To address such problems, various examinations have been made with respect to the method for suppressing the formation of the deposit.

For example, Patent Literature 1 discloses a lubricating oil composition containing 14 mass % or more of a fraction having a boiling point of 500 to 550° C. and 5 mass % or more of a fraction having a boiling point of more than 550° C., in order to provide a lubricating oil composition having improved performance of suppressing the formation of deposit.

CITATION LIST

Patent Literature

Patent Literature 1: JP-A-2016-196595

SUMMARY OF INVENTION

Technical Problem

Under such circumstances, for example, a new lubricating oil composition that is preferably applicable to lubrication of the diesel engine mounted with a supercharger has been desired.

Solution to Problem

The present invention provides a lubricating oil composition containing a base oil, and a non-boron-modified succinimide and a boron-modified succinimide at a predetermined ratio, and further containing either a metal-based detergent having a predetermined value or less of a base number as a metal-based detergent or an amine-based antioxidant with a content of a predetermined value or less.

Specific embodiments of the present invention are as described in the following [1] to [14].

[1] A lubricating oil composition comprising a base oil (A), a non-boron-modified succinimide (B), a boron-modified succinimide (C), a metal-based detergent (D), and an antioxidant (E), a content ratio [B/N] by mass of boron atoms derived from the component (C) to nitrogen atoms derived from the component (B) and the component (C) is 0.30 or less, and the lubricating oil composition satisfies at least one selected from the following requirements (I) and (II):

requirement (I): the component (D) contains a metal-based detergent (D1) having a base number of less than 100 mgKOH/g, requirement (II): the component (E) contains an amine-based antioxidant (E1), and a content of the component (E1) is 1.00 mass % or less based on the total amount of the lubricating oil composition.

[2] The lubricating oil composition according to the above [1], wherein the component (B) is at least one selected from a monosuccinimide (B1) represented by the following general formula (b-1) and a bis-succinimide (B2) represented by the following general formula (b-2):

(b-1)

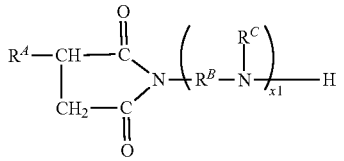

(b-2)

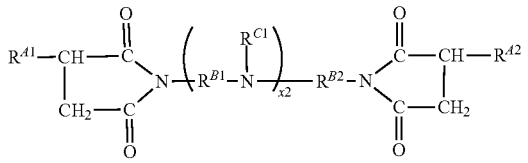

wherein $R^A$, $R^{A1}$ and $R^{A2}$ are each independently an alkenyl group having a mass-average molecular weight (Mw) of 500 to 3,000, $R^B$, $R^{B1}$ and $R^{B2}$ are each independently an alkylene group having 2 to 5 carbon atoms, $R^C$ and $R^{C1}$ are each independently a hydrogen atom, an alkyl group having 1 to 10 carbon atoms, or a group represented by $-(AO)_n—H$ (wherein each A is independently an alkylene group having 2 to 4 carbon atoms, and n is an integer of 1 to 10), and x1 is an integer of 1 to 10, and x2 is an integer of 0 to 10.

[3] The lubricating oil composition according to the above [1] or [2], wherein the lubricating oil composition satisfies both the requirements (I) and (II).

[4] The lubricating oil composition according to any one of the above [1] to [3], wherein a content of the component (D1) defined in the requirement (I) in terms of metal atoms is 0.005 to 0.080 mass % based on the total amount of the lubricating oil composition.

[5] The lubricating oil composition according to any one of the above [1] to [4], wherein the antioxidant (E) contains a phenol-based antioxidant (E2).

[6] The lubricating oil composition according to the above [5], wherein a content ratio [(E1)/(E2)] by mass of the component (E1) to the component (E2) is 0.01 to 0.60.

[7] The lubricating oil composition according to any one of the above [1] to [6], further comprising a viscosity index improver (F), wherein the component (F) contains at least one selected from a comb-shaped polymer (F1) and an olefin-based copolymer (F2).

[8] The lubricating oil composition according to the above [7], wherein the component (F) contains both the comb-shaped polymer (F1) and the olefin-based copolymer (F2), and a content ratio [(F2)/(F1)] by mass of the component (F2) to the component (F1) is 0.90 or less.

[9] The lubricating oil composition according to the above [8], wherein the component (F2) contains a star-shaped polymer (F21).

[10] The lubricating oil composition according to any one of the above [1] to [9], further comprising an anti-wear agent (G).

[11] The lubricating oil composition according to any one of the above [1] to [10], wherein an SAE viscosity grade of the lubricating oil composition is 0W-30 or 5W-30.

[12] The lubricating oil composition according to any one of the above [1] to [11], wherein the lubricating oil composition is used for a diesel engine mounted with a supercharger.

[13] A diesel engine mounted with a supercharger applied with the lubricating oil composition according to any one of the above [1] to [12].

[14] A method for using the lubricating oil composition, wherein the lubricating oil composition according to any one of the above [1] to [12] is applied to lubrication of a diesel engine mounted with a supercharger.

Advantageous Effects of Invention

Since the lubricating oil composition of a preferred embodiment of the present invention has a high effect of suppressing the formation of deposit, it is preferably applicable to lubrication of a diesel engine mounted with a supercharger.

DESCRIPTION OF EMBODIMENTS

In the present specification, a kinematic viscosity and a viscosity index mean values measured and calculated in accordance with JIS K2283:2000.

In the present specification, the weight average molecular weight (Mw) and the number average molecular weight (Mn) are values in terms of standard polystyrene measured by gel permeation chromatography (GPC), and specifically mean values measured by the method described in Examples.

In the present specification, the contents of metal atoms (for example, alkali metal atoms, alkaline earth metal atoms, zinc atoms), phosphorus atoms and boron atoms mean values measured in accordance with JPI-5S-38-2003, and the content of nitrogen atoms means a value measured in accordance with JIS K2609.

[Constitution of Lubricating Oil Composition]

The lubricating oil composition of the present invention contains a base oil (A), a non-boron-modified succinimide (B), a boron-modified succinimide (C), a metal-based detergent (D), and an antioxidant (E), and is prepared so that the content ratio [B/N] by mass of boron atoms derived from the component (C) to nitrogen atoms derived from the components (B) and (C) may be 0.30 or less.

Moreover, the lubricating oil composition of the present invention satisfies at least one selected from the following requirements (I) and (II).

Requirement (I): the component (D) contains a metal-based detergent (D1) having a base number of less than 100 mgKOH/g.

Requirement (II): the component (E) contains an amine-based antioxidant (E1), and the content of the component (E1) is 1.00 mass % or less based on the total amount of the lubricating oil composition.

The lubricating oil composition of the present invention is prepared so as to satisfy the above requirements, so that the effect of suppressing the formation of deposit (hereinafter, also referred to as the "deposit resistance") is high, and in particular, the lubricating oil composition of the present invention may effectively exhibit excellent deposit resistance upon continuous use under high temperature environment.

That is to say, it is considered that the lubricating oil composition of the present invention containing each component together with the component (C) and prepared so that the above content ratio [B/N] may be 0.30 or less effectively suppresses the formation of deposit attributable to boron in the component (C) and also have improved dispersibility so that the performance of each component upon compounding the components (D) and (E) can be more effectively exhibited. It is considered that, when adjustment is performed so that at least one selected from the requirements (I) and (II) may be satisfied in such a solution in which the dispersibility of the additive is improved, the performance of the component (D1) and the component (E1) is effectively exhibited, which can result in a lubricating oil composition having improved deposit resistance.

From the viewpoint of obtaining a lubricating oil composition having further improved deposit resistance, the lubricating oil composition of one embodiment of the present invention preferably satisfies both the above requirements (I) and (II).

From the above viewpoint, in the lubricating oil composition of one embodiment of the present invention, the content ratio [B/N] by mass of boron atoms derived from the component (C) to nitrogen atoms derived from the components (B) and (C) is 0.30 or less, and is preferably 0.28 or less, more preferably 0.26 or less, still more preferably 0.25 or less, still much more preferably 0.24 or less, particularly preferably 0.22 or less, and preferably 0.01 or more, more preferably 0.05 or more, still more preferably 0.07 or more, still much more preferably 0.09 or more, particularly preferably 0.11 or more.

That is to say, the content ratio [B/N] by mass is preferably 0.01 to 0.30, more preferably 0.01 to 0.28, more preferably 0.05 to 0.26, still more preferably 0.07 to 0.25, still much more preferably 0.09 to 0.24, and particularly preferably 0.11 to 0.22.

In the lubricating oil composition used in one embodiment of the present invention, the total content of nitrogen atoms derived from the component (B) and the component (C) is preferably 0.040 to 0.300 mass %, more preferably 0.045 to 0.250 mass %, still more preferably 0.050 to 0.200 mass %, still much more preferably 0.055 to 0.170 mass %, and particularly preferably 0.060 to 0.150 mass %, based on the total amount (100 mass %) of the lubricating oil composition.

Further, the total content of nitrogen atoms derived from the component (B) and the component (C) may be 0.062 mass % or more, 0.065 mass % or more, 0.067 mass % or more, or 0.070 mass % or more, or may be 0.140 mass % or less, 0.130 mass % or less, 0.120 mass % or less, 0.110 mass % or less, or 0.100 mass % or less, based on the total amount (100 mass %) of the lubricating oil composition.

In the lubricating oil composition of one embodiment of the present invention, the base number of the component (D1) defined in the requirement (I) is less than 100 mgKOH/g, and is preferably 90 mgKOH/g or less, more preferably 85 mgKOH/g or less, still more preferably 80 mgKOH/g or less, still much more preferably 75 mgKOH/g or less, particularly preferably 70 mgKOH/g or less, or further may be 65 mgKOH/g or less, 60 mgKOH/g or less, 50 mgKOH/g or less, 40 mgKOH/g or less, or 30 mgKOH/g or less.

The base number of the component (D1) defined in the requirement (I) is 0 mgKOH/g or more, and may be 5 mgKOH/g or more, 10 mgKOH/g or more, 15 mgKOH/g or more, 20 mgKOH/g or more, 25 mgKOH/g or more, 30 mgKOH/g or more, 35 mgKOH/g or more, or 40 mgKOH/g or more.

The base number of the component (D1) defined in the requirement (I) and the component (D2) described below means the base number measured by "perchloric acid method" in accordance with JIS K2501 "Petroleum products and lubricants—Determination of neutralization number", 7.

Then, in one embodiment of the present invention, in the lubricating oil composition that satisfies the requirement (I), the content of the component (D1) in terms of metal atoms is preferably 0.001 to 0.080 mass %, more preferably 0.005 to 0.060 mass %, still more preferably 0.007 to 0.050 mass %, still much more preferably 0.010 to 0.040 mass %, and particularly preferably 0.012 to 0.035 mass %, based on the total amount (100 mass %) of the lubricating oil composition.

Further, the content of the component (D1) in terms of metal atoms may be 0.015 mass % or more, 0.017 mass % or more, or 0.020 mass % or more, or may be 0.032 mass % or less, 0.030 mass % or less, or 0.027 mass % or less, based on the total amount (100 mass %) of the lubricating oil composition.

In one embodiment of the present invention, in the lubricating oil composition that satisfies the requirement (II), the content of the component (E1) is 1.00 mass % or less, and is preferably 0.90 mass % or less, more preferably 0.80 mass % or less, still more preferably 0.70 mass % or less, still much more preferably 0.65 mass % or less, particularly preferably 0.60 mass % or less, or further may be 0.55 mass % or less, or 0.50 mass % or less, and is preferably 0.01 mass % or more, more preferably 0.05 mass % or more, still more preferably 0.10 mass % or more, still much more preferably 0.15 mass % or more, particularly preferably 0.20 mass % or more, or further may be 0.25 mass % or more, or 0.30 mass % or more, based on the total amount (100 mass %) of the lubricating oil composition.

That is to say, in the lubricating oil composition that satisfies the requirement (II), the content of the component (E1) is preferably 0.01 to 1.00 mass %, more preferably 0.01 to 0.90 mass %, more preferably 0.05 to 0.80 mass % or less, still more preferably 0.10 to 0.70 mass %, still much more preferably 0.15 to 0.65 mass %, and particularly preferably 0.20 to 0.60 mass %, based on the total amount (100 mass %) of the lubricating oil composition.

The lubricating oil composition of one embodiment of the present invention preferably further contains at least one selected from the viscosity index improver (F) and the anti-wear agent (G), and more preferably contains both the viscosity index improver (F) and the anti-wear agent (G).

The lubricating oil composition of one embodiment of the present invention may further contain lubricating oil additives other than the components (B) to (G) when needed as long as the effects of the present invention are not impaired.

In the lubricating oil composition of one embodiment of the present invention, the total content of the components (A) to (E) is preferably 55 mass % or more, more preferably 65 mass % or more, still more preferably 70 mass % or more, still much more preferably 75 mass % or more, and particularly preferably 80 mass % or more, based on the total amount (100 mass %) of the lubricating oil composition.

In the lubricating oil composition of one embodiment of the present invention, the total content of the components (A) to (G) is preferably 60 mass % or more, more preferably 70 mass % or more, still more preferably 80 mass % or more, still much more preferably 90 mass % or more, and particularly preferably 95 mass % or more, based on the total amount (100 mass %) of the lubricating oil composition.

Hereinafter, details of each component contained in the lubricating oil composition of one embodiment of the present invention will be described.

<Component (A): Base Oil>

As the base oil which is the component (A) used in one embodiment of the present invention, one or more selected from mineral oils and synthetic oils can be mentioned.

Examples of the mineral oils include atmospheric residues obtained by subjecting crude oils, such as paraffinic crude oil, intermediate base crude oil and naphthenic crude oil, to atmospheric distillation; distillates obtained by subjecting these atmospheric residues to vacuum distillation; and refined oils obtained by subjecting the distillates to one or more of refining treatments, such as solvent deasphalting, solvent extraction, hydrocracking, solvent dewaxing, catalytic dewaxing, and hydrorefining.

Examples of the synthetic oils include poly-α-olefins, such as an α-olefin homopolymer and an α-olefin copolymer (for example, an α-olefin copolymer having 8 to 14 carbon atoms such as an ethylene-α-olefin copolymer); isoparaffin; polyalkylene glycol; ester oils, such as polyol ester, dibasic acid ester, and phosphoric acid ester; ether oils, such as polyphenyl ether; alkylbenzene; alkylnaphthalene; and synthetic oil (GTL) obtained by isomerizing wax (GTL WAX (Gas To Liquids WAX)) produced from natural gas through Fischer-Tropsch process or the like.

Among these, it is preferable to contain one or more selected from mineral oils classified in Group II and Group III of API (American Petroleum Institute) base oil categories, and synthetic oils, as the component (A) used in one embodiment of the present invention.

The kinematic viscosity of the component (A) used in one embodiment of the present invention at 100° C. is preferably 2.0 to 20.0 $mm^2/s$, more preferably 2.0 to 15.0 $mm^2/s$, still more preferably 3.0 to 12.0 $mm^2/s$, still much more preferably 3.2 to 9.0 $mm^2/s$, and particularly preferably 3.5 to 7.0 $mm^2/s$.

The viscosity index of the component (A) used in one embodiment of the present invention is appropriately set depending on the applications of the lubricating oil composition, and is preferably 70 or more, more preferably 80 or more, still more preferably 90 or more, still much more preferably 100 or more, and particularly preferably 110 or more.

When a mixed oil that is a combination of two or more base oils is used as the component (A) in one embodiment of the present invention, the kinematic viscosity and the viscosity index of the mixed oil are preferably in the above ranges.

In the lubricating oil composition of one embodiment of the present invention, the content of the component (A) is preferably 30 to 98 mass %, more preferably 40 to 95 mass %, still more preferably 50 to 93 mass %, still much more preferably 60 to 90 mass %, and particularly preferably 65 to 87 mass %, based on the total amount (100 mass %) of the lubricating oil composition.

<Component (B): Non-Boron-Modified Succinimide>

The lubricating oil composition of the present invention contains a non-boron-modified succinimide (B).

The component (B) may be used alone or in combination of two or more.

The component (B) used in one embodiment of the present invention is preferably at least one selected from an alkenyl monosuccinimide (B1) represented by the following general formula (b-1) and an alkenyl bis-succinimide (B2) represented by the following general formula (b-2).

(b-1)

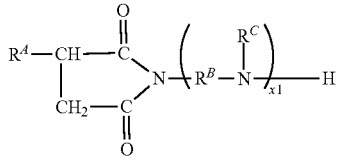

(b-2)

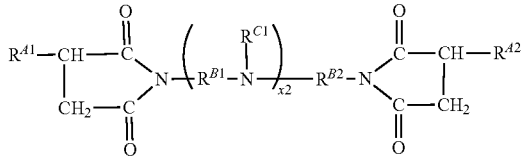

In the general formulae (b-1) and (b-2), $R^A$, $R^{A1}$ and $R^{A2}$ are each independently an alkenyl group having a weight average molecular weight (Mw) of 500 to 3,000 (preferably 1,000 to 3,000). Examples of the alkenyl group include a polybutenyl group, a polyisobutenyl group and an ethylene-propylene copolymer, and among these, a polybutenyl group or a polyisobutenyl group is preferable.

$R^B$, $R^{B1}$ and $R^{B2}$ are each independently an alkylene group having 2 to 5 carbon atoms.

$R^C$ and $R^{C1}$ are each independently a hydrogen atom, an alkyl group having 1 to 10 carbon atoms, or a group represented by $-(AO)_n—H$ (wherein each A is independently an alkylene group having 2 to 4 carbon atoms, and n is an integer of 1 to 10).

x1 is an integer of 1 to 10, preferably an integer of 2 to 5, and more preferably 3 or 4.

x2 is an integer of 0 to 10, preferably an integer of 1 to 5, and more preferably an integer of 2 to 4.

In the component (B) used in one embodiment of the present invention, it is preferable that $R^C$ and $R^{C1}$ in the general formulae (b-1) and (b-2) be not a hydrogen atom, but are a compound that is an alkyl group having 1 to 10 carbon atoms or a group represented by $-(AO)_n—H$. By using such a compound as the component (B), the heat resistance and the cleanliness can be further improved, which can result in a lubricating oil composition having further improved deposit resistance.

From the viewpoint of obtaining a lubricating oil composition having further improved deposit resistance, the component (B) used in one embodiment of the present invention preferably contains at least the alkenyl monosuccinimide (B1) represented by the general formula (b-1).

In the lubricating oil composition used in one embodiment of the present invention, the content of the component (B) in terms of nitrogen atoms is preferably 0.005 to 0.120 mass %, more preferably 0.007 to 0.100 mass %, still more preferably 0.010 to 0.080 mass %, still much more preferably 0.015 to 0.070 mass %, and particularly preferably 0.020 to 0.065 mass %, based on the total amount (100 mass %) of the lubricating oil composition.

<Component (C): Boron-Modified Succinimide>

The lubricating oil composition of the present invention contains a boron-modified succinimide (C) together with the component (B).

The component (C) may be used singly, or may be used in combination of two or more.

The component (C) is contained together with the component (B) and is used to adjust the content ratio [B/N] of boron atoms derived from the component (C) to nitrogen atoms derived from the components (B) and (C) to 0.30 or less. Then, the content ratio [B/N] is adjusted to 0.30 or less, so that a lubricating oil composition that is excellent in deposit resistance can be obtained.

The component (C) used in one embodiment of the present invention may be a boron-modified monosuccinimide, or may be a boron-modified bis-succinimide.

Specific examples thereof include a boron-modified product of an alkenyl monosuccinimide represented by the general formula (b-1) and a boron-modified product of an alkenyl bis-succinimide represented by the general formula (b-2).

The ratio [B/N] by mass of boron atoms to nitrogen atoms which constitute the component (C) used in one embodiment of the present invention is preferably 0.10 to 0.90, more preferably 0.15 to 0.80, still more preferably 0.20 to 0.70, still much more preferably 0.25 to 0.60, and particularly preferably 0.30 to 0.50.

In the lubricating oil composition used in one embodiment of the present invention, the content of boron atoms derived from the component (C) is preferably 0.001 to 0.070 mass %, more preferably 0.003 to 0.060 mass %, still more preferably 0.006 to 0.050 mass %, still much more preferably 0.008 to 0.040 mass %, and particularly preferably 0.010 to 0.035 mass %, based on the total amount (100 mass %) of the lubricating oil composition.

Further, the content of boron atoms derived from the component (C) may be 0.011 mass % or more, 0.012 mass % or more, or 0.013 mass % or more, or may be 0.032 mass % or less, 0.030 mass % or less, 0.027 mass % or less, 0.025 mass % or less, 0.023 mass % or less, or 0.020 mass % or less, based on the total amount (100 mass %) of the lubricating oil composition.

In the lubricating oil composition used in one embodiment of the present invention, the content of the component (C) in terms of nitrogen atoms is preferably 0.015 to 0.180 mass %, more preferably 0.020 to 0.150 mass %, still more preferably 0.025 to 0.120 mass %, still much more preferably 0.030 to 0.100 mass %, and particularly preferably 0.032 to 0.085 mass %, based on the total amount (100 mass %) of the lubricating oil composition.

<Other Ashless Dispersants>

The lubricating oil composition of one embodiment of the present invention may contain an ashless dispersant other than the components (B) and (C) as long as the effects of the present invention are not impaired.

Examples of such other ashless dispersants include monosuccinimide, bis-succinimide, benzylamine, succinates, and boron-modified products thereof.

However, in the lubricating oil composition of one embodiment of the present invention, the content of the ashless dispersant other than the components (B) and (C) is preferably 0 to 50 parts by mass, more preferably 0 to 30 parts by mass, still more preferably 0 to 10 parts by mass, still much more preferably 0 to 5 parts by mass, and particularly preferably 0 to 1 part by mass per 100 parts by mass in total of the components (B) and (C) contained in the lubricating oil composition.

<Component (D): Metal-Based Detergent>

The lubricating oil composition of the present invention contains a metal-based detergent (D). By containing the component (D), the cleanliness and the dispersibility are improved, so that a lubricating oil composition that is excellent in deposit resistance can be obtained.

The component (D) may be used singly, or may be used in combination of two or more.

The component (D) used in one embodiment of the present invention is preferably one or more selected from a metal salicylate, a metal phenate, and a metal sulfonate each of which contains a metal atom selected from an alkali metal atom and an alkaline earth metal atom.

As the metal atom, sodium, calcium, magnesium, or barium is preferable, and calcium is more preferable. That is to say, the component (D) is preferably a calcium-based detergent.

As the metal sulfonate, a compound represented by the following general formula (d-1) is preferable, as the metal salicylate, a compound represented by the following general formula (d-2) is preferable, and as the metal phenate, a compound represented by the following general formula (d-3) is preferable.

(d-1)

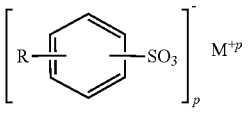

(d-2)

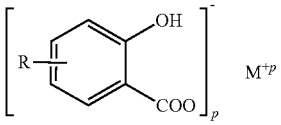

(d-3)

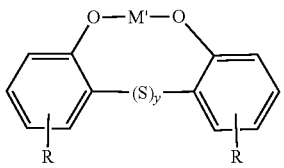

In the general formulae (d-1) and (d-2), M is a metal atom selected from alkali metals and alkaline earth metals; sodium, calcium, magnesium, or barium is preferable, and calcium is more preferable.

In the general formula (d-3), M' is an alkaline earth metal, calcium, magnesium, or barium is preferable, and calcium is more preferable. y is an integer of 0 or more, and preferably an integer of 0 to 3.

In the general formulae (d-1) to (d-3), p is a valence of M, and 1 or 2. R is a hydrogen atom or a hydrocarbon group having 1 to 18 carbon atoms.

Examples of the hydrocarbon groups capable of being selected as R include an alkyl group having 1 to 18 carbon atoms, an alkenyl group having 1 to 18 carbon atoms, a cycloalkyl group having 3 to 18 ring-forming carbon atoms, an aryl group having 6 to 18 ring-forming carbon atoms, an alkylaryl group having 7 to 18 carbon atoms, and an arylalkyl group having 7 to 18 carbon atoms.

When the above requirement (I) is satisfied, the component (D) contains the metal-based detergent (D1) having a base number of less than 100 mgKOH/g. As the component (D1), at least one selected from metal sulfonate and metal salicylate is preferably contained, and at least calcium sulfonate or calcium sulfonate is more preferably contained.

In the lubricating oil composition of one embodiment of the present invention, the total content ratio of metal sulfonate (preferably calcium sulfonate) and metal salicylate (preferably calcium salicylate) in the component (D1) is preferably 50 to 100 mass %, more preferably 60 to 100 mass %, still more preferably 70 to 100 mass %, still much more preferably 80 to 100 mass %, and particularly preferably 90 to 100 mass %, based on the total amount (100 mass %) of the component (D1) contained in the lubricating oil composition.

When the above requirement (I) is satisfied, the component (D) preferably contains a metal-based detergent (D2) having a base number of 100 mgKOH/g or more together with the component (D1).

When the above requirement (I) is satisfied, the content ratio [(D1)/(D2)] by mass of the component (D1) to the component (D2) in terms of metal atoms is preferably 1/99 to 50/50, more preferably 1.5/98.5 to 40/60, still more preferably 2/98 to 30/70, still much more preferably 2.5/97.5 to 25/75, and particularly preferably 3/97 to 20/80.

When the above requirement (I) is not satisfied, the component (D) contains the component (D2).

The base number of the component (D2) used in one embodiment of the present invention is 100 mgKOH/g or more, and is preferably 110 mgKOH/g or more, more preferably 120 mgKOH/g or more, still more preferably 150 mgKOH/g or more, still much more preferably 180 mgKOH/g or more, particularly preferably 200 mgKOH/g or more, and preferably 600 mgKOH/g or less, more preferably 550 mgKOH/g or less, still more preferably 500 mgKOH/g or less, still much more preferably 450 mgKOH/g or less, and particularly preferably 400 mgKOH/g or less.

That is to say, the base number of the component (D2) is preferably 100 to 600 mgKOH/g, more preferably 110 to 600 mgKOH/g, more preferably 120 to 550 mgKOH/g, still more preferably 150 to 500 mgKOH/g, still much more preferably 180 to 450 mgKOH/g, and particularly preferably 200 to 400 mgKOH/g.

As the component (D2), metal salicylate is preferably contained, and calcium salicylate is more preferably contained.

In the lubricating oil composition of one embodiment of the present invention, the content ratio of metal salicylate (preferably calcium salicylate) in the component (D2) is preferably 50 to 100 mass %, more preferably 60 to 100 mass %, still more preferably 70 to 100 mass %, still much more preferably 80 to 100 mass %, and particularly preferably 90 to 100 mass %, based on the total amount (100 mass %) of the component (D2) contained in the lubricating oil composition.

In the lubricating oil composition of one embodiment of the present invention, the content of the component (D) in terms of metal atoms is preferably 0.010 to 0.600 mass %, more preferably 0.030 to 0.500 mass %, still more preferably 0.060 to 0.450 mass %, still much more preferably 0.100 to 0.400 mass %, and particularly preferably 0.130 to 0.300 mass %, based on the total amount (100 mass %) of the lubricating oil composition.

<Component (E): Antioxidant>

The lubricating oil composition of the present invention contains an antioxidant (E). By containing the component (E), the oxidation stability is improved, so that a lubricating oil composition that is excellent in deposit resistance can be obtained.

The component (E) may be used singly, or may be used in combination of two or more.

Examples of the component (E) used in one embodiment of the present invention include an amine-based antioxidant, a phenol-based antioxidant, a molybdenum-based antioxidant, a sulfur-based antioxidant and a phosphorous-based antioxidant.

Here, when the above requirement (II) is satisfied, the component (E) contains an amine-based antioxidant (E1).

Examples of the amine-based antioxidant include diphenylamine-based antioxidants, such as diphenylamine, and alkylated diphenylamine including an alkyl group having 3 to 20 carbon atoms; and naphthylamine-based antioxidants, such as α-naphthylamine, phenyl-α-naphthylamine, and substituted phenyl-α-naphthylamine including an alkyl group having 3 to 20 carbon atoms.

When the above requirement (II) is satisfied, the component (E) preferably contains a phenol-based antioxidant (E2) in addition to the component (E1).

Also, when the above requirement (II) is not satisfied, the component (E) preferably contains a phenol-based antioxidant.

Examples of the phenol-based antioxidant include monophenol-based antioxidants, such as 2,6-di-t-butylphenol, 2,6-di-t-butyl-4-methylphenol, 2,6-di-t-butyl-4-ethylphenol, C7-C9 alkyl-3-(3,5-di-t-butyl-4-hydroxyphenyl)propionate, isooctyl-3-(3,5-di-t-butyl-4-hydroxyphenyl)propionate and octadecyl-3-(3,5-di-t-butyl-4-hydroxyphenyl) propionate; diphenol-based antioxidants, such as 4,4'-methylenebis(2,6-di-t-butylphenol) and 2,2'-methylenebis(4-ethyl-6-t-butylphenol); and hindered phenol antioxidants.

When the above requirement (II) is satisfied, the content ratio [(E1)/(E2)] by mass of the component (E1) to the component (E2) is preferably 0.01 to 0.60, more preferably 0.03 to 0.50, still more preferably 0.05 to 0.40, still much more preferably 0.07 to 0.35, and particularly preferably 0.10 to 0.30.

In the lubricating oil composition of one embodiment of the present invention, the content of the component (E2) is preferably 0.1 to 7.0 mass %, more preferably 0.5 to 6.0 mass %, still more preferably 0.7 to 5.5 mass %, still much more preferably 1.0 to 5.0 mass %, and particularly preferably 1.5 to 4.0 mass %, based on the total amount (100 mass %) of the lubricating oil composition.

In the lubricating oil composition used in one embodiment of the present invention, the content of the component (E) is preferably 0.1 to 8.0 mass %, more preferably 0.5 to 7.2 mass %, still more preferably 0.8 to 6.7 mass %, still much more preferably 1.2 to 5.2 mass %, and particularly preferably 1.6 to 4.7 mass %, based on the total amount (100 mass %) of the lubricating oil composition.

<Component (F): Viscosity Index Improver>

The lubricating oil composition of one embodiment of the present invention preferably further contains a viscosity index improver (F). By containing the component (F), a lubricating oil composition that is excellent in fuel-saving performance can be obtained.

The component (F) may be used singly, or may be used in combination of two or more.

In the lubricating oil composition of one embodiment of the present invention, the content of the component (F) is preferably 0.1 to 10.0 mass %, more preferably 0.5 to 8.0 mass %, still more preferably 0.7 to 6.0 mass %, still much more preferably 1.0 to 4.0 mass %, and particularly preferably 1.2 to 2.5 mass %, based on the total amount (100 mass %) of the lubricating oil composition.

The component (F) used in one embodiment of the present invention preferably contains one or more selected from a comb-shaped polymer (F1) and an olefin-based copolymer (F2), and from the viewpoint of obtaining a lubricating oil composition having further improved deposit resistance, preferably contains both the comb-shaped polymer (F1) and the olefin-based copolymer (F2).

In the component (F) used in one embodiment of the present invention, from the viewpoint of obtaining a lubricating oil composition having further improved deposit resistance, the content ratio [(F2)/(F1)] by mass of the component (F2) to the component (F1) is preferably 0.90 or less, more preferably 0.80 or less, still more preferably 0.70 or less, and still much more preferably 0.60 or less, and from the viewpoint of obtaining a lubricating oil composition having more improved shear stability, it is preferably 0.05 or more, more preferably 0.10 or more, still more preferably 0.12 or more, and still much more preferably 0.15 or more.

That is to say, from the aforementioned viewpoints, the content ratio [(F2)/(F1)] by mass of the component (F2) to the component (F1) is preferably 0.05 to 0.90, more preferably 0.10 to 0.80, still more preferably 0.12 to 0.70, and still much more preferably 0.15 to 0.60.

<Component (F1): Comb-Shaped Polymer>

The comb-shaped polymer which is the component (F1) used in one embodiment of the present invention is only required to be a polymer having a structure including a large number of three-way branch points from which a side chain having a high-molecular weight comes out, in the main chain.

The component (F1) used in one embodiment of the present invention is preferably a polymer at least having a structural unit (X1) derived from a macromonomer (x1). This structural unit (X1) corresponds to the aforementioned "side chain having a high-molecular weight".

In the present invention, the above "macromonomer (x1)" means a high-molecular weight monomer having a polymerizable functional group, and is preferably a high-molecular weight monomer having a polymerizable functional group at a terminal thereof.

In the component (F1) used in one embodiment of the present invention, the content of the structural unit (X1) is preferably 0.5 to 20 mol %, more preferably 0.7 to 10 mol %, and still more preferably 0.9 to 5 mol %, based on the total amount (100 mol %) of the structural unit of the component (F1).

In the present specification, the content of each structural unit in the component (F1) and the component (F2) means a value calculated by analyzing the $^{13}$C-NMR quantitative spectrum.

The number average molecular weight (Mn) of the macromonomer (x1) is preferably 300 or more, more preferably 400 or more, still more preferably 500 or more, and preferably 100,000 or less, more preferably 50,000 or less, still more preferably 20,000 or less.

That is to say, the number average molecular weight (Mn) of the macromonomer (x1) is preferably 300 to 100,000, more preferably 400 to 50,000, and still more preferably 500 to 20,000.

Examples of the polymerizable functional group included in the macromonomer (x1) include an acryloyl group ($CH_2$═CH—COO—), a methacryloyl group ($CH_2$═$CCH_3$—COO—), an ethenyl group ($CH_2$═CH—), a vinyl ether group ($CH_2$═CH—O—), an allyl group ($CH_2$═CH—$CH_2$—), an allyl ether group ($CH_2$—CH—$CH_2$—O—), a group represented by $CH_2$═CH—CONH—, and a group represented by $CH_2$═$CCH_3$—CONH—.

In addition to the above polymerizable functional group, the macromonomer (x1) may have, for example, one or more repeating units represented by the following general formulae (i) to (iii).

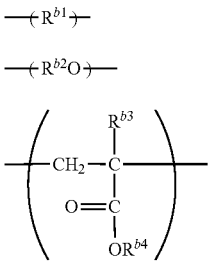

(i)

(ii)

(iii)

In the above general formula (i), $R^{b1}$ is a linear or branched alkylene group having 1 to 10 carbon atoms.

In the general formula (ii), $R^{b2}$ is a linear or branched alkylene group having 2 to 4 carbon atoms.

In the general formula (iii), $R^{b3}$ is a hydrogen atom or a methyl group. $R^{b4}$ is a linear or branched alkyl group having 1 to 10 carbon atoms.

When the macromonomer (x1) has a plurality of repeating units represented by each of the above general formulae (i) to (iii), $R^{b1}$, $R^{b2}$, $R^{b3}$ and $R^{b4}$ may be each the same as one another or may be different from one another.

In one embodiment of the present invention, the macromonomer (x1) is preferably a polymer having a repeating unit represented by the general formula (i), and more preferably a polymer having a repeating unit (X1-1) in which $R^{b1}$ in the general formula (i) is at least one selected from a 1,2-butylene group and a 1,4-butylene group.

The content of the repeating unit (X1-1) is preferably 1 to 100 mol %, more preferably 20 to 95 mol %, still more preferably 40 to 90 mol %, and still much more preferably 50 to 80 mol %, based on the total amount (100 mol %) of the structural unit of the macromonomer (x1).

When the macromonomer (x1) is a copolymer having two or more repeating units selected from the general formulae (i) to (iii), the form of copolymerization may be a block copolymer or may be a random copolymer.

The component (F1) used in one embodiment of the present invention may be a homopolymer consisting only of a structural unit (X1) derived from one macromonomer (x1), or may be a copolymer having a structural unit (X1) derived from two or more macromonomers (x1).

The component (F1) used in one embodiment of the present invention may be a copolymer having a structural unit (X2) derived from a monomer other than the macromonomer (x1) together with a structural unit (X1) derived from a macromonomer (x1).

As a specific structure of such a comb-shaped polymer, a copolymer having a side chain including the structural unit (X1) derived from the macromonomer (x1) relative to the main chain including the structural unit (X2) derived from the monomer (x2) is preferable.

Examples of the monomer (x2) include alkyl (meth) acrylate, a nitrogen atom-containing vinyl monomer, a hydroxyl group-containing vinyl monomer, a phosphorus atom-containing monomer, an aliphatic hydrocarbon-based vinyl monomer, a cycloaliphatic hydrocarbon-based vinyl monomer, vinyl ester, vinyl ether, vinyl ketone, an epoxy group-containing vinyl monomer, a halogen element-containing vinyl monomer, an ester of unsaturated polycarboxylic acid, (di)alkyl fumarate, (di)alkyl maleate, and an aromatic hydrocarbon-based vinyl monomer.

The monomer (x2) is preferably a monomer other than the phosphorus atom-containing monomer and the aromatic hydrocarbon-based vinyl monomer, more preferably includes one or more selected from a monomer represented by the following general formula (a1), alkyl(meth)acrylate, and a hydroxyl group-containing vinyl monomer, and still more preferably includes at least a hydroxyl group-containing vinyl monomer (x2-d).

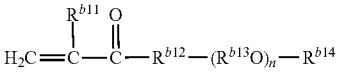

(a1)

In the general formula (a1), $R^{b11}$ is a hydrogen atom or a methyl group.

$R^{b12}$ is a single bond, a linear or branched alkylene group having 1 to 10 carbon atoms, —O—, or —NH—.

$R^{b13}$ is a linear or branched alkylene group having 2 to 4 carbon atoms. Moreover, n represents an integer of 1 or more (preferably an integer of 1 to 20, and more preferably an integer of 1 to 5). When n is an integer of 2 or more, each $R^{b13}$ may be the same as one another or may be different from one another, and further, the $(R^{b13}O)_n$ moiety may be a random bond or a block bond.

$R^{b14}$ is a linear or branched alkyl group having 1 to 60 (preferably 10 to 50, and more preferably 20 to 40) carbon atoms.

From the viewpoint of obtaining a lubricating oil composition having further improved deposit resistance, the weight average molecular weight (Mw) of the component (F1) used in one embodiment of the present invention is preferably 200,000 or more, more preferably 250,000 or more, still more preferably 300,000 or more, still much more preferably 350,000 or more, particularly preferably 450,000 or more, and preferably 1,000,000 or less, more preferably 900,000 or less, still more preferably 800,000 or less, still much more preferably 750,000 or less, particularly preferably 700,000 or less.

That is to say, the weight average molecular weight (Mw) of the component (F1) is preferably 200,000 to 1,000,000, more preferably 250,000 to 900,000, still more preferably 300,000 to 800,000, still much more preferably 350,000 to 750,000, and particularly preferably 450,000 to 700,000.

From the viewpoint of obtaining a lubricating oil composition having further improved deposit resistance, the molecular weight distribution (Mw/Mn) of the component (F1) used in one embodiment of the present invention (wherein Mn represents the number average molecular weight of the component (F1)) is preferably 8.00 or less, more preferably 7.00 or less, still more preferably 6.00 or less, still much more preferably 4.00 or less, and particularly preferably 3.00 or less, and preferably 1.01 or more, more preferably 1.02 or more, still more preferably 1.05 or more, still much more preferably 1.07 or more, and particularly preferably 1.10 or more.

That is to say, the molecular weight distribution (Mw/Mn) of the component (F1) is preferably 1.01 to 8.00, more preferably 1.02 to 7.00, still more preferably 1.05 to 6.00, still much more preferably 1.07 to 4.00, and particularly preferably 1.10 to 3.00.

From the viewpoint of obtaining a lubricating oil composition having further improved deposit resistance, SSI (shear stability index) of the component (F1) used in one embodiment of the present invention is preferably 100 or less, more preferably 80 or less, still more preferably 70 or less, still much more preferably 60 or less, and particularly preferably 50 or less.

The lower limit value of SSI of the component (F1) is not particularly limited, and is usually 0.1 or more.

In the present specification, SSI (shear stability index) represents a decrease in viscosity caused by shear derived from the polymer component by percentage, and is a value measured in accordance with JPI-5S-29-06, more specifically, a value calculated by the following expression (1).

$$SSI(\%)=(Kv_0-Kv_1)/(Kv_0-K_{voil})\times 100 \quad \text{Expression (1)}$$

In the above expression (1), $Kv_0$ is a value of the kinematic viscosity of a sample oil at 100° C. in which the polymer component is diluted in a mineral oil, and $Kv_1$ is a value of the kinematic viscosity of the sample oil at 100° C. in which the polymer component is diluted in a mineral oil, after being subjected to irradiation with ultrasonic wave for 30 minutes by an output method in accordance with the procedures of JPI-5S-29-06. Moreover, $Kv_{oil}$ is a value of the kinematic viscosity of the mineral oil at 100° C. used when the polymer component is diluted.

The value of SSI of the component (F1) varies with the structure of the comb-shaped polymer. Specifically, there are following tendencies, and by considering these matters, the value of SSI of the component (F1) can be easily adjusted. The following matters are merely examples, and the value of SSI of the component (F1) can also be adjusted by considering matters other than these matters.

- A comb-shaped polymer whose side chain is constituted of the macromonomer (x1) and in which the content of the structural unit (X1) derived from the macromonomer (x1) is 0.5 mol % or more, based on the total amount (100 mol %) of the structural unit tends to have a low value of SSI.
- As the molecular weight of the macromonomer (x1) constituting the side chain of the comb-shaped polymer becomes higher, the value of SSI tends to become lower.

In the lubricating oil composition of one embodiment of the present invention, the content of the component (F1) is preferably 0.50 to 6.00 mass %, more preferably 0.85 to 5.00 mass %, more preferably 0.88 to 4.00 mass %, still more preferably 1.00 to 3.50 mass %, still much more preferably 1.20 to 3.00 mass %, and particularly preferably 1.45 to 2.50 mass %, based on the total amount (100 mass %) of the lubricating oil composition.

<Component (F2): Olefin-Based Copolymer>

The component (F2) used in one embodiment of the present invention is a copolymer having a structural unit derived from a monomer having an alkenyl group, and examples thereof include a copolymer of an α-olefin having 2 to 20 (preferably 2 to 16, more preferably 2 to 14) carbon atoms, and more specific examples thereof include an ethylene-α-olefin copolymer, a styrene-diene copolymer, and a styrene-isoprene copolymer.

The weight average molecular weight (Mw) of the component (F2) used in one embodiment of the present invention is preferably 200,000 or more, more preferably 300,000 or more, still more preferably 400,000 or more, still much more preferably 500,000 or more, particularly preferably 550,000 or more, and preferably 1,000,000 or less, more preferably 900,000 or less, still more preferably 800,000 or less, still much more preferably 750,000 or less, and particularly preferably 700,000 or less.

That is to say, the weight average molecular weight (Mw) of the component (F2) is preferably 200,000 to 1,000,000, more preferably 300,000 to 900,000, still more preferably 400,000 to 800,000, still much more preferably 500,000 to 750,000, and particularly preferably 550,000 to 700,000.

The molecular weight distribution (Mw/Mn) of the component (F2) used in one embodiment of the present invention (wherein Mn represents the number average molecular weight of the component (F2)) is preferably 8.00 or less, more preferably 7.00 or less, still more preferably 6.00 or less, still much more preferably 3.00 or less, particularly preferably 2.00 or less, and preferably 1.001 or more, more preferably 1.005 or more, still more preferably 1.01 or more, still much more preferably 1.02 or more, particularly preferably 1.03 or more.

That is to say, the molecular weight distribution (Mw/Mn) of the component (F2) is preferably 1.001 to 8.00, more preferably 1.005 to 7.00, still more preferably 1.01 to 6.00, still much more preferably 1.02 to 3.00, and particularly preferably 1.03 to 2.00.

SSI (shear stability index) of the component (F2) used in one embodiment of the present invention is preferably 60 or less, more preferably 40 or less, still more preferably 30 or less, still much more preferably 20 or less, and particularly preferably 15 or less.

The lower limit value of SSI of the component (F2) is not particularly limited, and is usually 0.1 or more.

In the lubricating oil composition of one embodiment of the present invention, the content of the component (F2) is preferably 0.10 to 2.00 mass %, more preferably 0.15 to 1.70 mass %, still more preferably 0.17 to 1.50 mass %, still much more preferably 0.20 to 1.20 mass %, and particularly preferably 0.25 to 1.00 mass %, based on the total amount (100 mass %) of the lubricating oil composition.

From the viewpoint of obtaining a lubricating oil composition having good deposit resistance and shear stability, in the lubricating oil composition of one embodiment of the present invention, the component (F2) preferably contains a star-shaped polymer (F21).

In the lubricating oil composition of one embodiment of the present invention, the content ratio of the component (F21) in the component (F2) is preferably 50 to 100 mass %, more preferably 70 to 100 mass %, still more preferably 80 to 100 mass %, still much more preferably 90 to 100 mass %, and particularly preferably 95 to 100 mass %, based on the total amount (100 mass %) of the component (F2) contained in the lubricating oil composition.

The star-shaped polymer which is the component (F21) used in one embodiment of the present invention is only required to be a polymer having a structure in which three or more chain polymers are bonded at one point.

Examples of the chain polymer constituting the component (F21) include copolymers of a vinyl aromatic monomer and a conjugated diene monomer and hydrides thereof.

Examples of the vinyl aromatic monomer include styrenes, alkyl-substituted styrenes having 8 to 16 carbon atoms, alkoxy-substituted styrenes having 8 to 16 carbon atoms, vinyl naphthalenes, and alkyl-substituted vinyl naphthalenes having 8 to 16 carbon atoms.

Examples of the conjugated diene monomer include conjugated dienes having 4 to 12 carbon atoms, and specific examples thereof include 1,3-butadiene, isoprene, piperylene, 4-methylpenta-1,3-diene, 3,4-dimethyl-1,3-hexadiene, and 4,5-diethyl-1,3-octadiene.

<Viscosity Index Improver Other than Components (F1) and (F2)>

The lubricating oil composition of one embodiment of the present invention may contain a viscosity index improver other than the components (F1) and (F2) as long as the effects of the present invention are not impaired.

However, the content of the viscosity index improver other than the components (F1) and (F2) is preferably 0 to 50 parts by mass, more preferably 0 to 30 parts by mass, still more preferably 0 to 10 parts by mass, and still much more preferably 0 to 1 part by mass, based on the total amount (100 parts by mass) of the components (F1) and (F2) contained in the lubricating oil composition.

<Component (G): Anti-Wear Agent>

The lubricating oil composition of one embodiment of the present invention preferably further contains an anti-wear agent (G).

The component (G) may be used singly, or may be used in combination of two or more.

Examples of the component (G) used in one embodiment of the present invention include sulfur-containing compounds, such as zinc dialkyldithiophosphate (ZnDTP), zinc phosphate, zinc dithiocarbamate, molybdenum dithiocarbamate, molybdenum dithiophosphate, disulfides, sulfurized olefins, sulfurized fats and oils, sulfurized esters, thiocarbonates, thiocarbamates, and polysulfides; phosphorus-containing compounds, such as phosphites, phosphates, phosphonates, and amine salts or metal salts thereof; sulfur- and phosphorus-containing anti-wear agents, such as thiophosphites, thiophosphates, thiophosphonates, and amine salts or metal salts thereof.

Among these, zinc dialkyldithiophosphate (ZnDTP) is preferably contained as the component (G). Examples of zinc dialkyldithiophosphate include the compound represented by the following general formula (g-1).

(g-1)

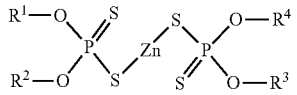

In the above formula (g-1), $R^1$ to $R^4$ each independently represents a hydrocarbon group, and may be the same as one another or may be different from one another.

The number of carbon atoms of the hydrocarbon group capable of being selected as $R^1$ to $R^4$ is preferably 1 to 20, more preferably 1 to 16, still more preferably 3 to 12, and still much more preferably 3 to 10.

Specific examples of the hydrocarbon groups capable of being selected as $R^1$ to $R^4$ include alkyl groups, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group and an octadecyl group; alkenyl groups, such as an octenyl group, a nonenyl group, a decenyl group, an undecenyl group, a dodecenyl group, a tridecenyl group, a tetradecenyl group and a pentadecenyl group; cycloalkyl groups, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group and a heptylcyclohexyl group; aryl groups, such as a phenyl group, a naphthyl group, an anthracenyl group, a biphenyl group and a terphenyl group; alkylaryl groups, such as a tolyl group, a dimethylphenyl group, a butylphenyl group, a nonylphenyl group, a methylbenzyl group and a dimethylnaphthyl group; and arylalkyl groups, such as a phenylmethyl group, a phenylethyl group and a diphenylmethyl group.

Among these, preferable are alkyl groups, and more preferable are primary or secondary alkyl groups, as the hydrocarbon groups capable of being selected as $R^1$ to $R^4$.

In the lubricating oil composition of one embodiment of the present invention, the content of the component (G) is preferably 0.01 to 3.0 mass %, more preferably 0.05 to 2.5 mass %, still more preferably 0.10 to 2.0 mass %, and still much more preferably 0.20 to 1.8 mass %, based on the total amount (100 mass %) of the lubricating oil composition.

When zinc dialkyldithiophosphate (ZnDTP) is contained as the component (G) in the lubricating oil composition of one embodiment of the present invention, the content of ZnDTP in terms of zinc atoms is preferably 0.01 to 1.0 mass %, more preferably 0.03 to 0.80 mass %, still more preferably 0.05 to 0.60 mass %, still much more preferably 0.08 to 0.50 mass %, and particularly preferably 0.10 to 0.40 mass %, based on the total amount (100 mass %) of the lubricating oil composition.

The content of ZnDTP in terms of phosphorus atoms is preferably 0.01 to 1.0 mass %, more preferably 0.02 to 0.70 mass %, still more preferably 0.03 to 0.50 mass %, still much more preferably 0.05 to 0.40 mass %, and particularly preferably 0.07 to 0.30 mass %, based on the total amount (100 mass %) of the lubricating oil composition.

<Lubricating Oil Additives>

The lubricating oil composition of one embodiment of the present invention may further contain lubricating oil additives other than the components (B) to (G) when needed as long as the effects of the present invention are not impaired.

Examples of such lubricating oil additives include a pour point depressant, a demulsifier, a friction modifier, a corrosion inhibitor, a metal deactivator, an anticorrosive, an antistatic, and an anti-foaming agent.

These lubricating oil additives may be each used singly, or may be each used in combination of two or more.

The contents of these lubricating oil additives can be each appropriately adjusted as long as the effects of the present invention are not impaired, but the contents of the additives are each independently usually 0.001 to 15 mass %, preferably 0.005 to 10 mass %, and more preferably 0.01 to 5 mass %, based on the total amount (100 mass %) of the lubricating oil composition.

<Production Method for Lubricating Oil Composition>

The production method for the lubricating oil composition of one embodiment of the present invention is not particularly limited, but from the viewpoint of productivity, preferable is a method having a step of compounding the components (B) to (E), and if necessary, the components (F) to (G) and other lubricating oil additives with the component (A).

From the viewpoint of compatibility with the component (A), the resin component such as the component (F) is preferably in a form of a solution dissolved in a diluent oil and the solution is preferably compounded with the component (A).

[Properties of Lubricating Oil Composition]

The kinematic viscosity of the lubricating oil composition of one embodiment of the present invention at 40° C. is preferably 10 to 130 $mm^2/s$, more preferably 20 to 115 $mm^2/s$, still more preferably 25 to 100 $mm^2/s$, still much more preferably 30 to 90 $mm^2/s$, and particularly preferably 35 to 80 $mm^2/s$.

The kinematic viscosity of the lubricating oil composition of one embodiment of the present invention at 100° C. is preferably 6.0 to 16.0 $mm^2/s$, more preferably 8.0 to 14.0 $mm^2/s$, still more preferably 8.5 to 13.5 $mm^2/s$, still much more preferably 9.0 to 13.0 $mm^2/s$, and particularly preferably 9.3 to 12.5 $mm^2/s$.

The viscosity index of the lubricating oil composition of one embodiment of the present invention is preferably 90 or more, more preferably 100 or more, still more preferably 110 or more, and still much more preferably 130 or more.

The SAE viscosity grade of the lubricating oil composition of one embodiment of the present invention is preferably 0W-30 or 5W-30. In these SAE viscosity grades, the lubricating oil composition can sufficiently exhibit various performance when being applied to lubrication of the diesel engine mounted with a supercharger.

The acid value of the lubricating oil composition of one embodiment of the present invention is preferably 0.30 to 4.00 mgKOH/g, more preferably 0.70 to 3.50 mgKOH/g, still more preferably 1.20 to 3.20 mgKOH/g, and still much more preferably 1.50 to 3.00 mgKOH/g.

In the present specification, the acid value of the lubricating oil composition means a value measured in accordance with JIS K2501:2003 (potentiometric titration method).

The base number of the lubricating oil composition of one embodiment of the present invention is preferably 2.0 to 12.0 mgKOH/g, more preferably 4.0 to 11.0 mgKOH/g, still more preferably 5.0 to 10.0 mgKOH/g, and still much more preferably 7.0 to 9.5 mgKOH/g.

In the present specification, the base number of the lubricating oil composition means a value measured in accordance with JIS K2501:2003 (perchloric acid method).

The content of boron atoms of the lubricating oil composition of one embodiment of the present invention is preferably 0.001 to 0.070 mass %, more preferably 0.003 to 0.060 mass %, still more preferably 0.006 to 0.050 mass %, still much more preferably 0.008 to 0.040 mass %, and particularly preferably 0.010 to 0.035 mass %, based on the total amount of the lubricating oil composition.

Further, the content of boron atoms of the lubricating oil composition of one embodiment of the present invention may be 0.011 mass % or more, 0.012 mass % or more, or 0.013 mass % or more, or may be 0.032 mass % or less, 0.030 mass % or less, 0.027 mass % or less, 0.025 mass % or less, 0.023 mass % or less, or 0.020 mass % or less, based on the total amount (100 mass %) of the lubricating oil composition.

The content of nitrogen atom of the lubricating oil composition of one embodiment of the present invention is preferably 0.025 to 0.400 mass %, more preferably 0.030 to 0.300 mass %, still more preferably 0.040 to 0.250 mass %, still much more preferably 0.050 to 0.200 mass %, and particularly preferably 0.060 to 0.170 mass %, based on the total amount of the lubricating oil composition.

Further, the content of nitrogen atom of the lubricating oil composition of one embodiment of the present invention may be 0.070 mass % or more, 0.080 mass % or more, 0.090 mass % or more, or 0.100 mass % or more, or may be 0.160 mass % or less, 0.150 mass % or less, 0.140 mass % or less, or 0.130 mass % or less, based on the total amount (100 mass %) of the lubricating oil composition.

[Use Application of Lubricating Oil Composition]

As described above, since the lubricating oil composition of one embodiment of the present invention has a high effect of suppressing the formation of deposit, it is preferably applicable to lubrication of a diesel engine mounted with a supercharger.

The amount of deposited materials that occurs when the lubricating oil composition of one embodiment of the present invention is subjected to a hot tube test in accordance with JPI-5S-55-99 at a temperature in a glass tube of 300° C. is preferably 40.0 mg or less, more preferably 35 mg or less, more preferably 30 mg or less, still more preferably 20 mg or less, still more preferably 10 mg or less, still much more preferably 6.5 mg or less, still much more preferably 5.0 mg or less, and particularly preferably 4.0 mg or less.

The amount of coking that occurs when the lubricating oil composition of one embodiment of the present invention is subjected to a panel coking test in accordance with Fed. Test Method Std. 791-3462 under conditions of a panel temperature of 350° C. and an oil temperature of 100° C. with a splash time of 3 hours without stop time is preferably 400 mg or less, more preferably 385 mg or less, more preferably 345 mg or less, still more preferably 320 mg or less, still more preferably 300 mg or less, still much more preferably 250 mg or less, still much more preferably 200 mg or less, and particularly preferably 170 mg or less.

The amount of deposited materials that occurs when the above hot tube test is carried out is an index of the amount of deposit that occurs along with the continuous use of the lubricating oil composition, and it is deemed that as the value of the amount of deposited materials becomes lower, the lubricating oil composition has a higher effect of suppressing the formation of deposit even with the continuous use.

The amount of coking that occurs when the above panel coking test is carried out is an index of the amount of deposit that occurs when the lubricating oil composition is used under high temperature environment, and it is deemed that as the value of the amount of deposited materials becomes lower, the lubricating oil composition has a higher effect of suppressing the formation of deposit even when used under high temperature environment.

Specific measuring methods and measurement conditions of the above hot tube test and panel coking test are as described in Examples described below.

When the aforementioned characteristics of the lubricating oil composition of one embodiment of the present invention are taken into consideration, the present invention can also provide the following [1] and [2].

[1] A diesel engine mounted with a supercharger applied with the aforementioned lubricating oil composition of one embodiment of the present invention.

[2] A method for using the lubricating oil composition, wherein the aforementioned lubricating oil composition of one embodiment of the present invention is applied to lubrication of a diesel engine mounted with a supercharger.

EXAMPLES

Next, the present invention will be described in much more detail with reference to Examples, but the present invention is in no way limited to these Examples. Measuring methods and evaluation methods for various properties are as follows.

(1) Kinematic Viscosity, Viscosity Index

The kinematic viscosity and viscosity index were measured and calculated in accordance with JIS K2283:2000.

(2) Contents of Calcium Atoms, Boron Atoms, Zinc Atoms, and Phosphorus Atoms

The contents were measured in accordance with JPI-5S-38-2003.

(3) Content of Nitrogen Atoms

The contents were measured in accordance with JIS K2609.

(4) Weight Average Molecular Weight (Mw), Number Average Molecular Weight (Mn)

Using a gel permeation chromatograph apparatus (manufactured by Agilent Technologies, Inc., "1260 model HPLC"), the weight-average molecular weight was measured under the following conditions, and a value measured in terms of standard polystyrene was used.

(Measurement Conditions)

Column: sequentially connected two of "Shodex LF404".

Column temperature: 35° C.

Developing solvent: chloroform

Flow rate: 0.3 mL/min

The ratio [Mw/Mn] of the measured weight average molecular weight (Mw) to the number average molecular weight (Mn) was calculated as the molecular weight distribution.

(5) SSI (Shear Stability Index)

A mineral oil serving as the diluent oil was added to a polymer serving as the measurement object to prepare a sample oil, and by using the sample oil and the mineral oil, SSI was measured in accordance with JPI-5S-29-06.

Specifically, each value of $Kv_0$, $Kv_1$, and $K_{voil}$ in the expression (1) was measured for a polymer serving as the object, and then SSI was calculated by the expression (1).

(6) Base Number

The base number was measured in accordance with JIS K2501:2003 (perchloric acid method).

(7) Acid Value

The acid value was measured in accordance with JIS K2501:2003 (potentiometric titration method).

Examples 1 to 8 and Comparative Examples 1 to 3

Each additive was compounded with the base oil in the types and compounding amounts shown in Tables 1 and 2, thereby preparing each lubricating oil composition. The compounding amount of the viscosity index improver described in Tables 1 and 2 describes the compounding amount in terms of active ingredients (in terms of solid content) from which the mass of the diluent oil was excluded, even when the viscosity index improver was compounded in a state being dissolved in the diluent oil.

Details of the base oil and each additive used in the preparation of each lubricating oil composition are as follows.

<Base Oil>

100N mineral oil: paraffinic mineral oil classified in Group III of API base oil categories, 40° C. kinematic viscosity=18.4 $mm^2/s$, 100° C. kinematic viscosity=4.1 $mm^2/s$, viscosity index=125.

<Succinimide>

Non-boron-modified succinimide (1): non-boron-modified succinimide represented by the general formula (b-1) or (b-2), nitrogen atom (N) content=1.0 mass %.

Non-boron-modified succinimide (2): non-boron-modified bis-succinimide in which $R^{A1}$ and $R^{A2}$ are each an alkenyl group having Mw of 500 to 3,000 and $R^{C1}$ is a hydrogen atom in the general formula (b-2), nitrogen atom (N) content=1.15 mass %.

Boron-modified succinimide: boron-modified product of a succinimide represented by the general formula (b-1) or (b-2), boron atom (B) content=0.49 mass %, nitrogen atom (N) content=1.50 mass %, B/N=0.33.

<Metal-Based Detergent>

Neutral Ca sulfonate: base number (perchloric acid method)=17 mgKOH/g calcium sulfonate, Ca atom content=2.4 mass %.

Neutral Ca salicylate: base number (perchloric acid method)=64 mgKOH/g calcium salicylate, Ca atom content=2.3 mass %.

Overbased Ca salicylate: base number (perchloric acid method)=225 mgKOH/g calcium salicylate, Ca atom content=8.0 mass %.

<Antioxidant>

Amine-based antioxidant: 4,4'-dinonylphenylamine, nitrogen atom content=4.6 mass %.

Phenol-based antioxidant: C7-C9 alkyl-3-(3,5-di-t-butyl-4-hydroxyphenyl) propionate <Viscosity Index Improver>

Comb-shaped polymer: comb-shaped polymer, Mw=600,000, Mw/Mn=2.4, SSI=49.

Star-shaped polymer (OCP): star-shaped polymer, Mw 580,000, Mw/Mn=1.1, SSI=14.

<Anti-Wear Agent>

ZnDTP: secondary zinc alkyldithiophosphate, P content=7.0 mass %, Zn atom content=8.3 mass %.

<Other Additives>

Additive mixture: mixture of additives including pour point depressant and anti-foaming agent together with friction modifier and metal deactivator.

Regarding the lubricating oil composition prepared, the 40° C. kinematic viscosity, 100° C. kinematic viscosity, viscosity index, acid value, and base number were measured or calculated in accordance with the aforementioned method, and the following evaluation was carried out. The results of them are set forth in Tables 1 and 2.

(1) Hot Tube Test

The lubricating oil composition prepared was subjected to the hot tube test in accordance with JPI-5S-55-99. Specifically, while keeping the temperature in a glass tube having an internal diameter of 2 mm, whose mass was measured in advance, at 300° C., the lubricating oil composition prepared and air were allowed to continuously flow in the glass tube at a flow rate of 0.3 mL/hour and a flow rate of 10 mL/minute for 16 hours, respectively. Then, the mass of the glass tube after testing was measured, and the difference with the mass of the glass tube before testing was calculated as the amount of deposited materials attached inside the glass tube (unit: mg). It is deemed that a lubricating oil composition generating a lower amount of deposited materials has a higher effect of suppressing the formation of deposit.

(2) Panel Coking Test

The lubricating oil composition prepared was continuously sprayed to a panel in accordance with Fed. Test Method Std. 791-3462 using a panel coking test apparatus under conditions of a panel temperature of 350° C. and an oil temperature of 100° C. with a splash time of 3 hours without stop time. After completion of the test, the weight of the panel was measured, and based on the difference with the panel weight before testing, the amount of coking attached to the panel was measured. It is deemed that a lubricating oil composition generating a lower amount of coking has a higher effect of suppressing the formation of deposit.

TABLE 1

| | | | | Example 1 | Example 2 | Example 3 | Example 4 | Comparative Example 1 |
|---|---|---|---|---|---|---|---|---|
| Composition of lubricating oil composition | Base oil | 100N mineral oil | mass % | 75.09 | 72.43 | 75.18 | 75.73 | 73.48 |
| | Succinimide | Non-boron-modified succinimide (1) | mass % | 2.75 | 2.75 | 2.75 | 2.75 | 2.75 |
| | | Non-boron-modified succinimide (2) | mass % | | | | | |
| | | Boron-modified succinimide | mass % | 2.75 | 5.50 | 2.75 | 2.75 | 5.50 |
| | Metal-based detergent | Neutral Ca sulfonate | mass % | 1.05 | 1.05 | | 0.50 | |
| | | Neutral Ca salicylate | mass % | | | 1.05 | | |
| | | Overbased Ca salicylate | mass % | 2.31 | 2.62 | 2.62 | 2.62 | 2.62 |
| | Antioxidant | Amine-based antioxidant | mass % | 0.40 | | | | |
| | | Phenol-based antioxidant | mass % | 3.00 | 3.00 | 3.00 | 3.00 | 3.00 |
| | Viscosity index improver | Comb-shaped polymer | mass % | 1.61 | 1.61 | 1.61 | 1.61 | 1.61 |
| | | Star-shaped polymer (OCP) | mass % | 0.27 | 0.27 | 0.27 | 0.27 | 0.27 |
| | Anti-wear agent | ZnDTP | mass % | 1.50 | 1.50 | 1.50 | 1.50 | 1.50 |
| | Other additives | Additive mixture | mass % | 9.27 | 9.27 | 9.27 | 9.27 | 9.27 |
| | | Total | mass % | 100.00 | 100.00 | 100.00 | 100.00 | 100.00 |
| | Mass ratio of star-shaped polymer (OCP)/comb-shaped polymer | | — | 0.16 | 0.17 | 0.16 | 0.16 | 0.17 |
| | Content of neutral Ca detergent in terms of Ca atoms | | mass % | 0.025 | 0.025 | 0.024 | 0.012 | 0 |
| | Content of overbased Ca detergent in terms of Ca atoms | | mass % | 0.18 | 0.21 | 0.21 | 0.21 | 0.21 |
| | Content of each atom derived from succinimide | Content of B atoms derived from succinimide | mass % | 0.013 | 0.027 | 0.013 | 0.013 | 0.027 |
| | | Content of N atoms derived from succinimide | mass % | 0.07 | 0.11 | 0.07 | 0.07 | 0.11 |
| | | B/N ratio derived from succinimide | — | 0.20 | 0.25 | 0.20 | 0.20 | 0.25 |
| | Content of each atom in lubricating oil composition | Content of Ca atoms | mass % | 0.21 | 0.23 | 0.23 | 0.22 | 0.21 |
| | | Content of B atoms | mass % | 0.013 | 0.027 | 0.013 | 0.013 | 0.027 |
| | | Content of N atoms | mass % | 0.10 | 0.12 | 0.08 | 0.08 | 0.13 |
| | | Content of Zn atoms | mass % | 0.12 | 0.12 | 0.12 | 0.12 | 0.12 |
| | | Content of P atoms | mass % | 0.11 | 0.11 | 0.11 | 0.11 | 0.11 |
| | Various properties of lubricating oil composition | 40° C. kinematic viscosity | mm2/s | 47.1 | 50.3 | 46.5 | 45.7 | 49.1 |
| | | 100° C. kinematic viscosity | $mm^2/s$ | 10.4 | 10.9 | 10.2 | 10.1 | 10.7 |
| | | Viscosity index | — | 219 | 215 | 217 | 217 | 215 |
| | | Acid value | mgKOH/g | 2.8 | 2.6 | 2.8 | 2.8 | 2.1 |
| | | Base number | mgKOH/g | 7.7 | 7.9 | 8.2 | 7.7 | 8.0 |
| Evaluation | Hot tube test (300° C.) amount of deposited materials | | mg | 4.0 | 3.2 | 2.1 | 3.4 | 7.0 |
| | Panel coking test (350° C.) amount of coking | | mg | 165 | 318 | 143 | 142 | 447 |

TABLE 2

| | | | | Example 5 | Example 6 | Comparative Example 2 | Example 7 | Example 8 | Comparative Example 3 |
|---|---|---|---|---|---|---|---|---|---|
| Composition of lubricating oil composition | Base oil | 100N mineral oil | mass % | 73.08 | 73.08 | 75.83 | 76.14 | 73.39 | 78.58 |
| | Succinimide | Non-boron-modified succinimide (1) | | 2.75 | | | 2.75 | 5.50 | |
| | | Non-boron-modified succinimide (2) | mass % | | 2.40 | | | | |
| | | Boron-modified succinimide | mass % | 5.50 | 5.50 | 5.50 | 2.75 | 2.75 | 2.75 |
| | Metal-based detergent | Neutral Ca sulfonate | mass % | | | | | | |
| | | Neutral Ca salicylate | mass % | | | | | | |
| | | Overbased Ca salicylate | mass % | 2.62 | 2.62 | 2.62 | 2.31 | 2.31 | 2.62 |
| | Antioxidant | Amine-based antioxidant | mass % | 0.40 | 0.40 | 0.40 | 0.40 | 0.40 | 0.40 |
| | | Phenol-based antioxidant | mass % | 3.00 | 3.00 | 3.00 | 3.00 | 3.00 | 3.00 |
| | Viscosity index improver | Comb-shaped polymer | mass % | 1.61 | 1.61 | 1.61 | 1.61 | 1.61 | 1.61 |
| | | Star-shaped polymer (OCP) | mass % | 0.27 | 0.27 | 0.27 | 0.27 | 0.27 | 0.27 |

TABLE 2-continued

| | | | Example 5 | Example 6 | Comparative Example 2 | Example 7 | Example 8 | Comparative Example 3 |
|---|---|---|---|---|---|---|---|---|
| Anti-wear agent | ZnDTP | mass % | 1.50 | 1.50 | 1.50 | 1.50 | 1.50 | 1.50 |
| Other additives | Additive mixture | mass % | 9.27 | 9.62 | 9.27 | 9.27 | 9.27 | 9.27 |
| | Total | mass % | 100.00 | 100.00 | 100.00 | 100.00 | 100.00 | 100.00 |
| Mass ratio of star-shaped polymer (OCP)/comb-shaped polymer | | — | 0.17 | 0.17 | 0.17 | 0.17 | 0.17 | 0.17 |
| Content of neutral Ca detergent in terms of Ca atoms | | mass % | 0 | 0 | 0 | 0 | 0 | 0 |
| Content of overbased Ca detergent in terms of Ca atoms | | mass % | 0.21 | 0.21 | 0.21 | 0.18 | 0.18 | 0.21 |
| Content of each atom derived from succinimide | Content of B atoms derived from succinimide | mass % | 0.027 | 0.027 | 0.027 | 0.013 | 0.013 | 0.013 |
| | Content of N atoms derived from succinimide | mass % | 0.11 | 0.11 | 0.08 | 0.07 | 0.10 | 0.04 |
| | B/N ratio derived from succinimide | — | 0.25 | 0.24 | 0.33 | 0.20 | 0.14 | 0.33 |
| Content of each atom in lubricating oil composition | Content of Ca atoms | mass % | 0.21 | 0.21 | 0.21 | 0.18 | 0.18 | 0.21 |
| | Content of B atoms | mass % | 0.027 | 0.027 | 0.027 | 0.013 | 0.013 | 0.013 |
| | Content of N atoms | mass % | 0.14 | 0.14 | 0.12 | 0.10 | 0.13 | 0.08 |
| | Content of Zn atoms | mass % | 0.12 | 0.12 | 0.12 | 0.12 | 0.12 | 0.12 |
| | Content of P atoms | mass % | 0.11 | 0.11 | 0.11 | 0.11 | 0.11 | 0.11 |
| Various properties of lubricating oil composition | 40° C. kinematic viscosity | mm2/s | 50.5 | 49.0 | 41.1 | 42.3 | 48.7 | 36.9 |
| | 100° C. kinematic viscosity | $mm^2/s$ | 10.9 | 10.7 | 9.2 | 9.4 | 10.4 | 8.4 |
| | Viscosity index | — | 216 | 215 | 215 | 213 | 209 | 217 |
| | Acid value | mgKOH/g | 2.4 | 2.9 | 2.1 | 2.5 | 2.4 | 2.2 |
| | Base number | mgKOH/g | 9.0 | 9.4 | 9.2 | 7.4 | 7.9 | 8.0 |
| Evaluation | Hot tube test (300° C.) amount of deposited materials | mg | 1.9 | 28.3 | 42.6 | 8.7 | 6.3 | 50.8 |
| | Panel coking test (350° C.) amount of coking | mg | 341 | 382 | 410 | 68 | 105 | 350 |

Tables 1 and 2 reveal that the lubricating oil compositions prepared in Examples 1 to 8 have a lower amount of deposited materials in the hot tube test and a lower amount of coking in the panel coking test as compared with the lubricating oil compositions of Comparative Examples 1 to 3, and have a higher effect of suppressing the formation of deposit. In contrast, in the lubricating oil compositions prepared in Comparative Examples 1 to 3, at least one selected from the amount of deposited materials in the hot tube test and the amount of coking in the panel coking test is high, and as a result, there is a room for improvement in the effect of suppressing the formation of deposit.

The invention claimed is:

1. A lubricating oil composition, comprising:

a base oil (A);

a non-boron-modified succinimide (B);

a boron-modified succinimide (C);

a metal-based detergent (D); and an antioxidant (E), wherein the lubricating oil composition comprises no organo-molybdenum compound, wherein the lubricating oil composition comprises no sodium sulfonate, wherein a first B/N mass ratio of boron atoms derived from the boron-modified succinimide (C) to nitrogen atoms derived from the non-boron-modified succinimide (B) and the boron-modified succinimide (C) is 0.30 or less, wherein the lubricating oil composition satisfies at least one of requirements (I) and (II):

requirement (I): the metal-based detergent (D) comprises a metal-based detergent (D1) having a base number of less than 100 mgKOH/g, and requirement (II): the antioxidant (E) comprises an amine-based antioxidant (E1), and a content of the amine-based antioxidant (E1) is 1.00 mass % or less based on total lubricating oil composition mass, wherein a content of a phenol-based antioxidant (E2) is 3.00 mass % or less, based on total lubricating oil composition mass, and wherein a total content of the amine-based antioxidant (E1) and the phenol-based antioxidant (E2) is 3.40 mass % or less, based on the total lubricating oil composition mass.

2. The composition of claim 1, wherein the non-boron-modified succinimide (B) comprises a monosuccinimide (B1) of formula (b-1):

(b-1)

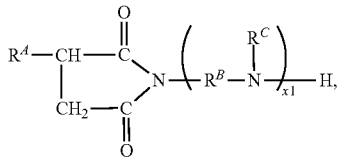

and/or a bis-succinimide (B2) of formula (b-2):

(b-2)

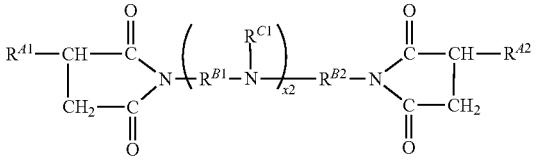

wherein $R^A$, $R^{A1}$, and $R^{A2}$ are each independently an alkenyl group having a mass-average molecular weight (Mw) in a range of from 500 to 3,000, $R^B$, $R^{B1}$, and $R^{B2}$ are each independently an alkylene group having 2 to 5 carbon atoms, $R^C$ and $R^{C1}$ are each independently H, an alkyl group having 1 to 10 carbon atoms, or a group represented by $-(AO)_n$—H, wherein each A is independently an alkylene group having 2 to 4 carbon atoms, and n is an integer in a range of from 1 to 10, and x1 is an integer in a range of from 1 to 10, and x2 is an integer in a range of from 0 to 10.

3. The composition of claim 1, wherein the lubricating oil composition satisfies both the requirements (I) and (II).

4. The composition of claim 1, wherein a content of the metal-based detergent (D1) defined in the requirement (I) in terms of metal atoms is in a range of from 0.005 to 0.080 mass %, based on the total lubricating oil composition mass.

5. The composition of claim 1, wherein the antioxidant (E) comprises the phenol-based antioxidant (E2).

6. The composition of claim 5, wherein an (E1)/(E2) mass content ratio of the amine-based antioxidant (E1) to the phenol-based antioxidant (E2) is in a range of from 0.01 to 0.60.

7. The composition of claim 1, further comprising:

a viscosity index improver (F), wherein the viscosity index improver (F) comprises a comb-shaped polymer (F1) and an olefin-based copolymer (F2).

8. The composition of claim 7, wherein the viscosity index improver (F) comprises both the comb-shaped polymer (F1) and the olefin-based copolymer (F2), and an (F2)/(F1) mass content ratio of the olefin-based copolymer (F2) to the comb-shaped polymer (F1) is 0.90 or less.

9. The composition of claim 8, wherein the olefin-based copolymer (F2) comprises a star-shaped polymer (F21).

10. The composition of claim 1, further comprising:

an anti-wear agent (G).

11. The composition of claim 1, wherein an SAE viscosity grade of the lubricating oil composition is 0W-30 or 5W-30.

12. The composition of claim 1, which is suitable for use in a diesel engine mounted with a supercharger.

13. A diesel engine, comprising:

a supercharger; and the lubricating oil composition of claim 1.

14. A method for using a lubricating oil composition, the method comprising:

lubricating a diesel engine mounted with a supercharger with the lubricating oil composition of claim 1.

15. The composition of claim 2, wherein the non-boron-modified succinimide (B) is at least one selected from the group consisting of the monosuccinimide (B1) of formula (b-1) and the bis-succinimide (B2) of formula (b-2).

16. The composition of claim 7, wherein the viscosity index improver (F) is at least one selected from the group consisting of a comb-shaped polymer (F1) and an olefin-based copolymer (F2).

17. The composition of claim 1, wherein a second B/N mass ratio of boron atoms to nitrogen atoms constituting the boron-modified succinimide (C) is less than 0.50.

18. The composition of claim 1, wherein a second B/N mass ratio of boron atoms to nitrogen atoms constituting the boron-modified succinimide (C) is in a range of from 0.10 to less than 0.50.

19. The composition of claim 1, wherein the metal-based detergent (D1), in terms of metal atoms, is 0.012 mass % or more.

20. The composition of claim 1, wherein the metal-based detergent (D1), in terms of metal atoms, is in a range of from 0.012 to 0.080 mass %.

* * * * *